US006991133B2

(12) United States Patent
Rutherford et al.

(10) Patent No.: US 6,991,133 B2
(45) Date of Patent: Jan. 31, 2006

(54) WALL MOUNTABLE PERSONAL CARE PRODUCTS USING STRETCH RELEASE ADHESIVES

(75) Inventors: Keith Leslie Rutherford, Palatine, IL (US); Guy Thompson, Inverness, IL (US); Mark Neuhalfen, Mt. Prospect, IL (US)

(73) Assignee: Unilever Home & Personal Care USA division of Conopco, Inc., Chicago, IL (US)

( * ) Notice: Subject to any disclaimer, the term of this patent is extended or adjusted under 35 U.S.C. 154(b) by 293 days.

(21) Appl. No.: 10/213,227

(22) Filed: Aug. 6, 2002

(65) Prior Publication Data

US 2004/0026455 A1 Feb. 12, 2004

(51) Int. Cl.
*B67D 5/006* (2006.01)

(52) U.S. Cl. ..... 222/181.3; 222/212; 222/490; 428/343

(58) Field of Classification Search ..... 222/181.1, 222/181.3, 206, 212, 213, 215, 490, 491, 222/494; 428/343, 40.1, 317.3
See application file for complete search history.

(56) References Cited

U.S. PATENT DOCUMENTS

| | | | | |
|---|---|---|---|---|
| 2,765,959 A | * | 10/1956 | Elliott | 222/181.2 |
| 3,456,850 A | * | 7/1969 | Uhlmann | 222/180 |
| 4,024,312 A | | 5/1977 | Korpman | |
| 4,470,523 A | | 9/1984 | Spector | |
| 4,793,517 A | | 12/1988 | Washut | |
| 5,022,625 A | | 6/1991 | Klinkhardt | |
| 6,001,471 A | | 12/1999 | Bries et al. | |
| 6,004,665 A | | 12/1999 | Luhmann et al. | 428/317.3 |
| 6,406,781 B1 | | 6/2002 | Hamerski | |
| 2002/0009568 A1 | | 1/2002 | Bries et al. | 428/40.1 |

FOREIGN PATENT DOCUMENTS

| | | |
|---|---|---|
| DE | 24 59 458 | 12/1974 |
| FR | 2 231 571 | 5/1973 |
| WO | 92/11332 | 7/1992 |
| WO | 92/11333 | 7/1992 |
| WO | 02/04571 | 1/2002 |

* cited by examiner

*Primary Examiner*—Gene Mancene
*Assistant Examiner*—Melvin A. Cartagena
(74) *Attorney, Agent, or Firm*—Karen E. Klumas

(57) ABSTRACT

A container which is adhered, in an inverted orientation, to a vertical surface (such as a wall or other vertical surface) of a kitchen, sink, or bath room by a stretch release adhesive, wherein said stretch release adhesive is resistant or substantially resistant to water and humidity, which container comprises:

a) one or more side surfaces, an end surface and a surface comprising an orifice;

b) a self-sealing valve which covers said orifice;

c) a construction or coating that is resistant or substantially resistant to external corrosion;

and wherein said container is dispensed by hand through the application of a force whose principal component acts perpendicularly or approximately perpendicularly to the vertical surface; is described.

19 Claims, 5 Drawing Sheets

WALL MOUNTABLE PERSONAL CARE PRODUCTS USING STRETCH RELEASE ADHESIVES

BACKGROUND OF THE INVENTION

The present invention is directed to a container for storing liquids, solids, aerosols, slurries, pastes, separable items, and the like, which container is also used in dispensing the contents thereof. The container of the invention may be used for storing and dispensing shampoo, hair conditioner, liquid cleaning agents, laundry detergents and a host of other contents, where such container stores the contents when not needed, and which container is used for dispensing the contents when such contents are needed for use. Conventional storage and dispensing containers, whether made of glass, metal or plastics, are generally stored upright on a shelf or floor, with the bottom surface of the container supporting it on the shelf, or the like. Such conventional containers, therefore, require available horizontal space or area for their storage, which often times is not available, or available only to a limited degree. Thus, available space, whether in a home, office, business, etc., must be judiciously apportioned for an optimum allocation of containers requiring storage. In addition, it often occurs that there is no horizontal shelf or support available for supporting the container at a location where it would be most convenient. The present invention solves these problems of limited or no horizontal support surface by providing a container, capable of multifarious uses, sizes, and shapes, which utilizes the vertical space available and provided by walls, shower stalls, shelf-doors, closet doors, and the like, thereby completely obviating the need or necessity of horizontal supporting surfaces for storing containers, while at the same time allowing for facile and quick dispensing.

Patents which relate to the field of the invention are as follows:

U.S. Pat. No. 4,793,517 discloses a resilient bottle or container that has three compartments for liquid soap, shampoo and conditioning rinse, respectively. A normally closed, openable valve controls a port in each compartment. The soap valve opens into the center of a sponge which is fastened to the bottle. The bottle can be supported on a vacuum cup on a shower wall for dispensing shampoo and conditioning rinse. On opening of any valve and manually depressing bottle, liquid is dispensed from the corresponding compartment.

U.S. Pat. No. 4,470,523 discloses a liquid soap dispenser whose container is formed of flexible plastic material and is provided with a flat rear wall and an externally-threaded nipple projecting from the front wall adjacent the base. The nipple has a cap screwed thereon which incorporates a pivoted spigot that when folded in seals the nipple and when folded out creates an outlet from which liquid soap is discharged when the front wall is pressed. Secured to the rear wall is a pad whose outer surface has a layer of pressure-sensitive adhesive thereon. Also provided is a base sheet whose area is greater than that of the pad, the sheet having a pressure-sensitive adhesive coating on its underface, making it possible to adhere and conform the sheet to a selected wall site, after which the container pad is pressed against the central zone of the sheet to securely anchor the dispenser on the wall.

U.S. Pat. No. 5,022,625 discloses a storage container that is capable of continual reuse, which container may be easily and readily stored on substantially any vertical surface in a home, office, business, and the like. The container has a rearwardly-facing concave-shaped cutout or depression formed in the rear surface thereof, which cutout or depression is used for receiving therein, in a force-fit manner, an enlarged sphere or convex-shaped knob secured to a vertical surface, such as a wall or door, by which the container may be removably mounted to such vertical surface, for subsequent removal therefrom when it is needed to dispense the contents of the container.

U.S. Pat. No. 4,024,312 discloses an easily removable pressure-sensitive adhesive which can be removed by stretching it lengthwise. WO 92/11332 discloses a high performance removable pressure-sensitive adhesive tape comprising a highly extensible backing bearing on at least one surface a layer of a photo-polymerized acrylic pressure sensitive adhesive. WO 92/11333 discloses an article suitable for adhering to a surface comprising a substrate bearing on one major surface thereof a removable adhesive tape comprising a highly extensible and substantially inelastic backing and a layer of pressure sensitive adhesive.

U.S. Pat. No. 6,406,781 discloses an adhesive article adapted for removable adhesive bonding on a support surface, such as a wall, includes a base member and a stretch release adhesive tape strip. The adhesive tape strip is a sequential release-type adhesive strip having a non-adhesive end portion which allows the base member to release from the adhesive strip during the removal process while the adhesive strip remains adhered to the support surface, therefore reducing the incidence of unwanted catapulting. To prevent relative movement between the base member and the adhesive strip during the removal process and therefore increase the likelihood of successful controlled sequential release of the base member, the base member includes a stabilizer arranged to abut the adhesive strip if the base member shifts as the adhesive strip is stretched during removal. The stabilizer can be a generally rigid projection or a compressible stop member which extends outwardly from the end of the base member adjacent the end of the adhesive strip.

U.S. Pat. No. 6,001,471 discloses double-sided stretchable adhesive tapes for use in conventional applications, particularly including the mounting or joining of an object to another surface. An improvement lies within the ability to control the timing of the de-bonding of both surfaces so that one adhesive surface releases before the other. The earlier release can be either on the object side or the surface side, depending on the desired effect. The present invention is applicable to all stretchable tape constructions including the use of plastic backing materials and/or elastic backing materials and allows such an object to be removed without risking substantial snap-back of the adhesive tape or catapulting of the object. The aforementioned advantages can be achieved by a double-sided adhesive tape having a stretchable backing layer, plastic or elastic, and having a lower-adhesion or non-adhesive portion of one adhesive surface, so that a corresponding greater adhesion adhesive portion of the other side remains more aggressively adhered to a surface during stretch removal while the portion of the one adhesive surface is less aggressively adhered or completely released from its surface. A non-adhesive portion may be adhesive-free, or may be an adhesive layer portion which is rendered non-adhesive. A lower-adhesion portion may comprise a low adhesion material, i.e., a weaker adhesive, or may be rendered lower in adhesion by a treatment or coating.

WO 20/010507 describes a stretch release adhesive tape construction that is removable from one or more objects to which it is adhered and which is re-usably separable within its construction allowing the separation and subsequent reconnection of articles. This tape is identified to be suitable for mounting applications on plaster, concrete, glass, metal or plastic and for applications that include wall hangings, dispensers, wire clips, carrying handles, closure applications, removable labels, diapers etc.

SUMMARY OF THE INVENTION

The present invention relates to a container which is adhered, in an inverted orientation, to a vertical surface such as a wall or other vertical surface. This could be the wall of a kitchen, sink, or bath room. The container is adhered by a stretch release adhesive, wherein said stretch release adhesive is resistant to water and humidity.

The container comprises:

a) one or more side surfaces, an end surface and a surface comprising an orifice;

b) a self-sealing valve which covers said orifice;

c) a construction or coating that is resistant or substantially resistant to external corrosion;

and wherein said container is dispensed by hand through the application of a force whose principal component acts perpendicularly or approximately perpendicularly to the vertical surface.

DETAILED DESCRIPTION OF THE INVENTION

As used herein liquids, solids, aerosols, slurries, pastes, and separable items, refers in general to all flowable and dispensable items.

Stretch release adhesive tapes are used to form powerful bonds between two opposed surfaces whilst allowing for their re-detachment by pulling on a tab which extends the tape essentially in the direction of the bond plane. This action separates the surfaces without leaving any trace or damage to the substrate or adherent. The materials and the methods by which they are made are well known in the art, for example as described in WO 92/11332, DE 3331016, DE 4233872, DE 4222849, DE 3331016, WO 94/21157 and WO 20/020124 all of which are hereby incorporated by reference in their entirety. Examples of such stretch release adhesives are commercially marketed under tradenames such as 'Command' adhesives by the 3M Innovative Properties Company and as 'tesa Power Strips' by Beiersdorf AG. Preferred classes are tapes that utilize acrylic, synthetic rubber or block copolymer based pressure sensitive adhesives in their construction.

Self sealing valve refers to any valve which seals itself under the weight of the product or items that are being dispensed or on removal of an applied force. A nonlimiting list of such valves would include Seaquist Perfect Dispensing valves such as the XT-90 Toggle; the ST-70 Toggle; the VX-80 Vertical; and the AR-70 Vertical available from the Seaquist Company. Another valve is the Super 90 Vertical, from the Precision Valve Corp. Another valve is the S-63 Tilt Action valve from the Summit Co. Another list of valves is the K Vertical; the KR Vertical; the T Tilt Action; and the TR Tilt Action all available from the Coster Co. Another valve is the Jetstar LI 98-Vertical from the Lindal Group. Examples of non-aerosol valves include the Simplisqueeze and Simplitwist valves from Seaquist Closures Inverted means that, when mounted, the exit orifice of the container is located in a position that is below its midpoint as defined by its center of gravity.

Deformable means that an appreciable and recoverable change in shape can be imparted through the application of a force that is easily imparted by the direct contact of a human hand.

Substantially resistant to external corrosion means that the container is able to be stored in a damp environment, typical of a domestic shower or washing unit, for six months without visual perception of localized areas of deterioration in the fabric of its construction. Non-limiting examples of materials which commonly offer this resistance in the current area of interest are plastics including thermosets, thermoplastics, rubbers and metals such as aluminum and some ferrous alloys such as stainless steels and combinations thereof.

Substantially resistant to water and humidity means that a component is able to fulfil its minimum performance requirements under the conditions of either direct contact with water, or air that is saturated with water vapor, for an exposure time that is typical of the application for which it is intended. As used herein this can be assessed using a method described in a later section for quantifying the time of exposure to water that is required for the container to become detached from a vertical surface.

The phenomenon of shear thinning is well known by practitioners in the art of rheology. The shear thinning index as used herein is the ratio of a fluid's low to high shear rate viscosity as measured at shear rates of $10^{-3}$ and $10^{3}$ $s^{-1}$ respectively.

Perpendicularly or approximately perpendicularly means at about a 110° to about a 70° or more preferably at about a 90° angle to the vertical surface. Inclined to the vertical surface means forming an included angle of about 10° to about 40° more preferably about 30° degrees away from the vertical surface wherein one side of said angle is said vertical surface pointing in a downward direction.

A vertically activated valve means a valve which is actuated by pressing the valve stem directly or almost directly into the container containing product. A tilt activated valve means a valve which is actuated by pressing the valve stem to one side of the container containing product.

A propellant is said to be fully miscible or partly miscible with concentrate, when it is fully soluble or partly soluble with the concentrate.

As used herein, laminate means a construction that is composed of two or more layers that have been designed so as to be separable at a time of choosing.

The containers of the present invention may be prepared from materials which are known in the art or which are analogous to those which are known in the art. The containers of the present invention may be made by methods which are known in the art or which are analogous to those which are known in the art.

The present invention relates to a container which is adhered, in an inverted orientation, to a vertical surface (such as a wall or other vertical surface) of a kitchen, sink, or bath room by a stretch release adhesive, wherein said stretch release adhesive is resistant or substantially resistant to water and humidity, which container comprises:

a) one or more side surfaces, an end surface and a surface comprising an orifice;

b) a self-sealing valve which covers said orifice;

c) a construction or coating that is resistant or substantially resistant to external corrosion;

and wherein said container is dispensed by hand through the application of a force whose principal component acts perpendicularly or approximately perpendicularly to the vertical surface.

There is a need for semi-automatic dispensing packages that can be easily mounted on vertical surfaces such as walls, shower stalls, shelf-doors, closet doors, and the like. Consumers are often frustrated by conventional bottles which rest usually on a horizontal storage space and have to be carried to the point of use and inverted prior to use and then dispensed. A container of the invention, by contrast, can be adhered to a vertical surface such as a wall, shower stall, a shelf-door, a closet door, and the like, and be immediately available for dispensing of product through a single handed operation.

This is accomplished by attaching to one or more surfaces of a container, such as a bottle, a stretch release adhesive tape and the adhering of said bottle via the stretch release adhesive upon a vertical surface such as a wall, a shower stall, a shelf-door, a closet door, and the like in an inverted orientation. Since a self sealing valve has been attached to the inverted end of said container, said container serves to store the shampoo, hair conditioner, liquid cleaning agents, laundry detergents, food materials or host of other contents, until the consumer dispenses said material.

The combination of a container and a stretch adhesive, for a personal care product or other material, allows such products to be used in both wet and dry environments and removed without damage to the wall, or other vertical surface that is used and at the time of the consumer's choosing. It was unexpected that very small amounts of these stretch release adhesives would support a heavy weight and the added pressure caused by the consumer upon dispensing. It was also unexpected that very small amounts of these stretch release adhesives would support a heavy weight in the humid and wet conditions that prevail, for example, in a shower stall or bath.

It was also unexpected that there could be caused such convenience for the consumer through the use of an aerosol package removably mounted by stretch release adhesives on, for example, a bathroom wall.

In another embodiment of a container of the invention, said container is made of a non-corrosive material such as a metal or plastic. This enables the container to be placed in a wet or humid environment without corrosion.

METHOD FOR ASSESSING RESISTANCE TO WATER AND HUMIDITY

The method described is applicable to any combination of container and adhesive strip and the protocol is designed to define embodiments of the invention that are of practical value in the domestic environment. The experiments that were conducted in support of this application comprised a wide range of container and adhesive combinations. These included a high density polyethylene bottle filled with a hair shampoo composition (mass 433 g, approximate dimensions 220 mm×80 mm×45 mm) supported by a stretch release adhesive tape of dimensions 20 mm×20 mm×1 mm. It also included a cylindrical painted aluminium aerosol can filled with a hair conditioning composition (mass 240 g, diameter 45 mm×height 170 mm) supported by a stretch release adhesive tape of dimensions 10 mm×40 mm×1 mm. The details of the method are described in the following section.

Description of Protocol

A smooth glass plate (surface roughness Ra<0.05 micrometers) is first cleaned with ethanol (190 proof and allowed to dry. A double sided stretch release adhesive is cut to the required dimensions and one of the protective backing strips is removed. The tape is then fixed over the centre-most point of a principal side wall of the container. The second protective backing strip is then removed from the adhesive tape and the container is pressed firmly against the glass plate, whilst supported on a measuring balance, to form an adhesive bond between the container and the glass plate. A force of 70 N is maintained for 10 seconds and then removed. The glass plate is then rotated to a vertical orientation for 5 minutes at 20 degrees C./50% RH. It is then placed within a sink and supported at an angle that is 5 degrees from the vertical and a jet of water (flow rate 4.5 liter/minute, temperature 38 degrees C.) is directed at the top of the plate, about 5 cm above the top of the container, using a flexible hose. This results in a continuous sheet of water flowing around the container and past the adhesive strip. The time required for the container to become detached under the action of its own weight is recorded. In this experiment, if the container is resistant to detachment for longer than 15 minutes it is considered to be substantially resistant to water and humidity. If it is resistant to detachment for longer than 60 minutes it is considered to be resistant to water and humidity. If it is resistant to detachment for longer than 1000 minutes or indefinitely it is considered to be highly resistant to water and humidity.

BRIEF DESCRIPTION OF THE DRAWINGS

Referring now to the drawings in greater detail, FIG. 1 shows a container 1 that may be used for storing and dispensing liquids, solids, and the like, such as shampoo, liquid detergent etc. The container is pressurized with a liquified propellant gas and may be made of metal, a thermoplastic resin material or other plastics or other suitable materials. The container 1 may be made by methods which are known in the art or by methods which are analogous to those which are known in the art. Container 1 has a convex shaped end surface 12, and a continuous side surface 2. Container 1 also has attached to said side surface a stretch release adhesive tape 16. The stretch release adhesive tape 16 adheres to vertical surface (not shown). A self sealing tilt action aerosol valve 8 can be seen to be in an inverted position and has an opening (not shown) through which product stored in container 1 can be dispensed. This process involves the application, by hand for example, of a force to the attached conduit 18 in a direction away from the vertical surface. FIG. 2 shows the container in FIG. 1 in an alternative perspective to aid clarity in the position of the different components.

FIG. 3 shows a container 30 that may be used for storing and dispensing liquids and the like, such as shampoo, conditioning compositions, liquid detergent etc. The container 30 is made of a flexible thermoplastic resin or other plastic material. The container 30 may be made by methods which are known in the art or by methods which are analogous to those which are known in the art. Container 30 has end surface 32, and side surface 34. Container 30 also has attached a stretch release adhesive tape 36 adhered to a side surface. The coating of stretch release adhesive 36 adheres to vertical surface (not shown). The orifice of the container (not shown) is covered with a split elastomeric seal (Simplisqueeze valve from Seaquist Closures, Mukwonago, Wis. USA) (not shown) through which product stored in container 30 can be dispensed. This process involves the application of a force to the flexible wall of the container in a direction, by hand for example, towards to the vertical surface.

FIG. 4 shows the container in FIG. 3 in an alternative perspective to aid clarity in the position of the different components.

Figure 1:
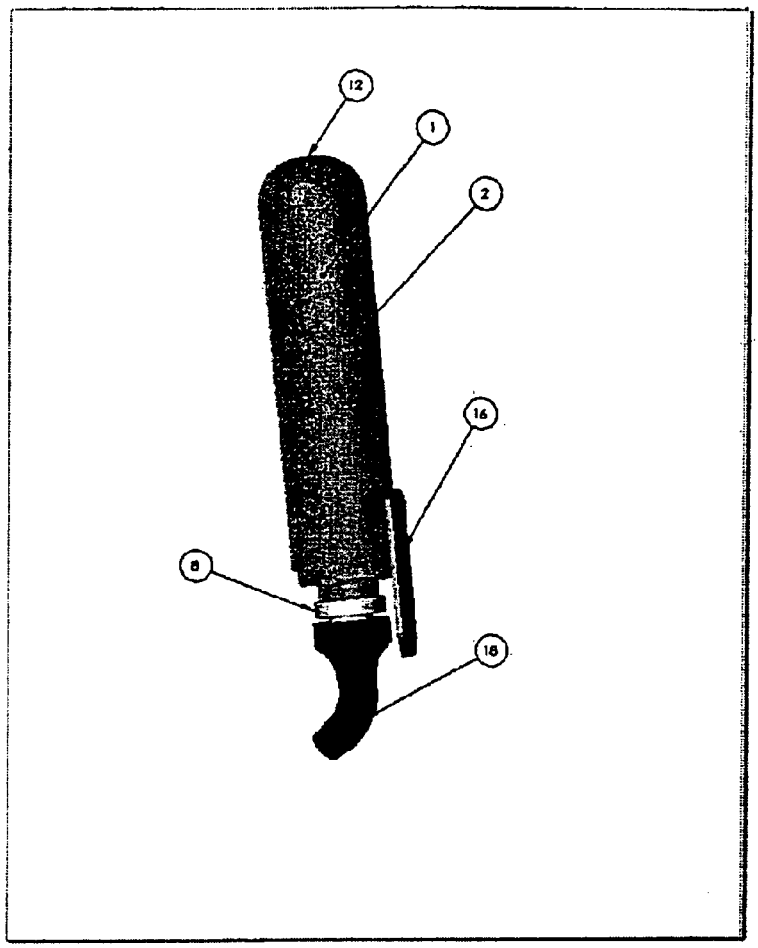
FIGS. 1 and 2 are different perspective views showing an embodiment of a container of the invention in an inverted position and attached to a vertical surface.
Figure 2:
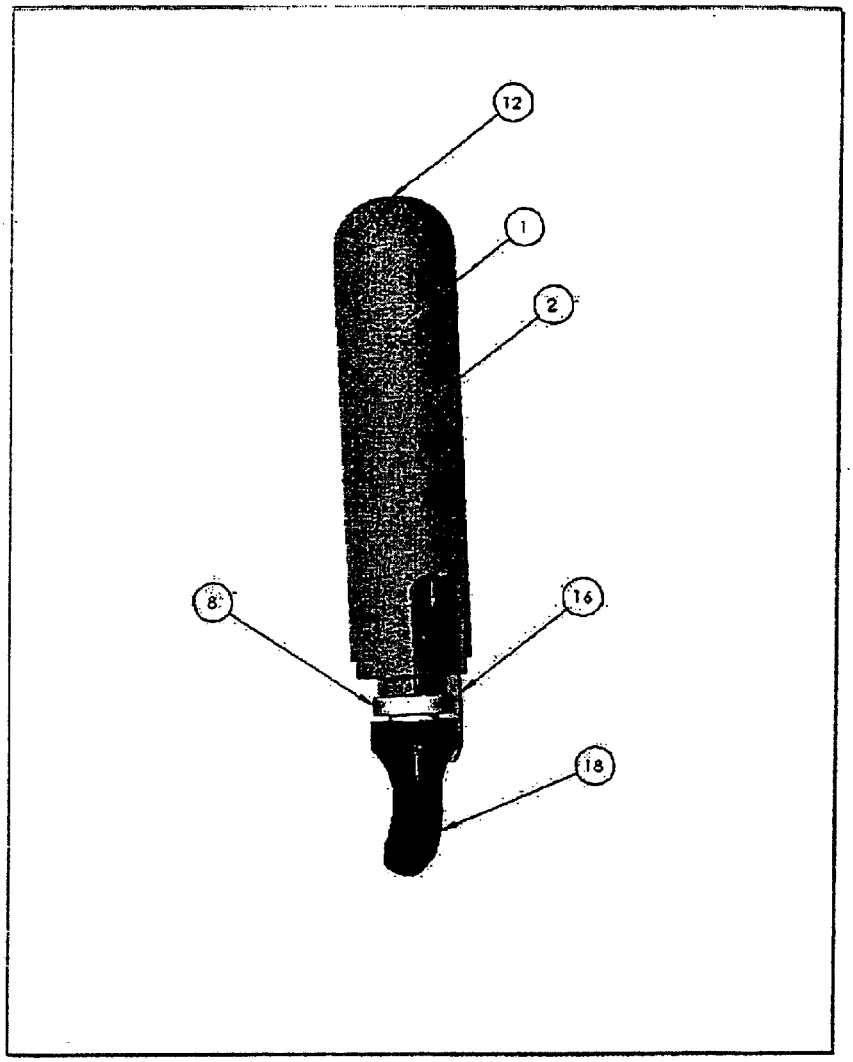
Figure 3:
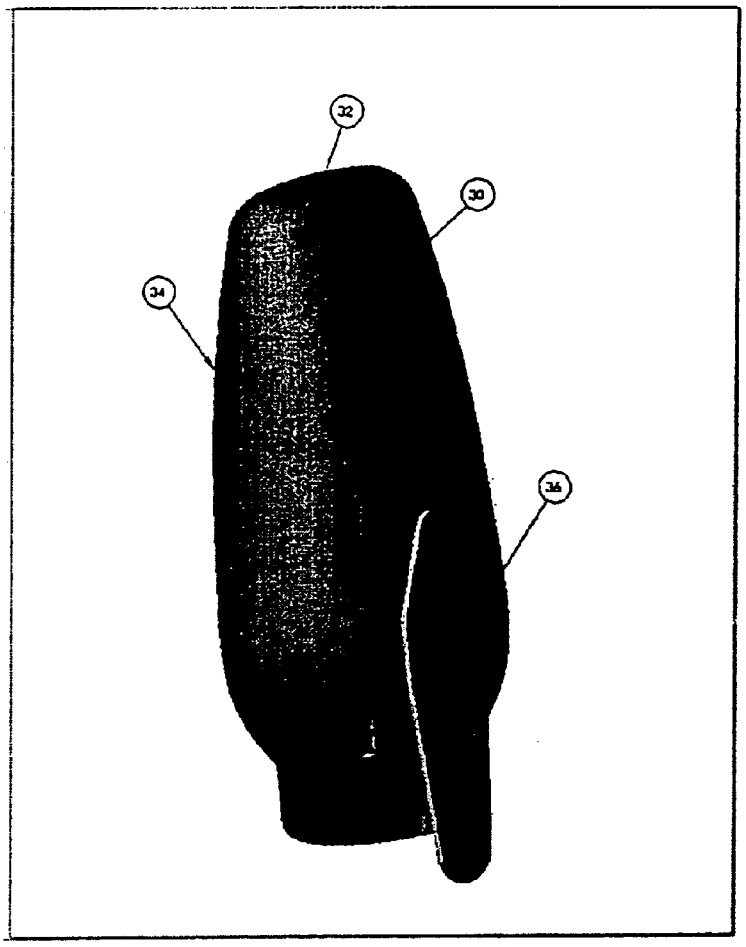
FIGS. 3 and 4 are perspective views showing a different embodiment of a container of the invention in an inverted position and, FIG. 5 shows an enlarged cross-section of the valve construction for this example.
Figure 4:
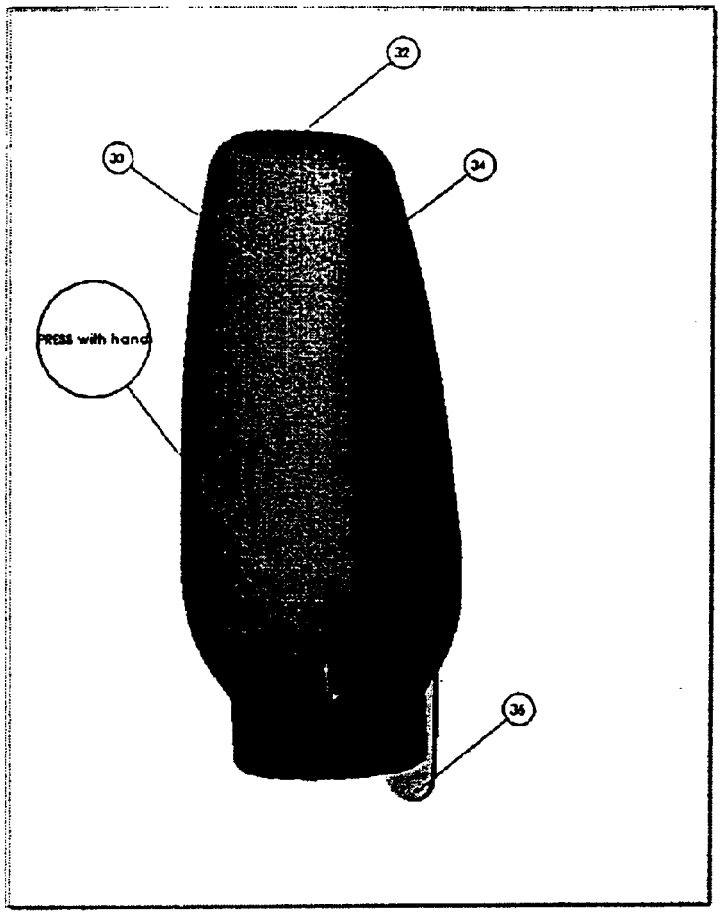
Figure 5:
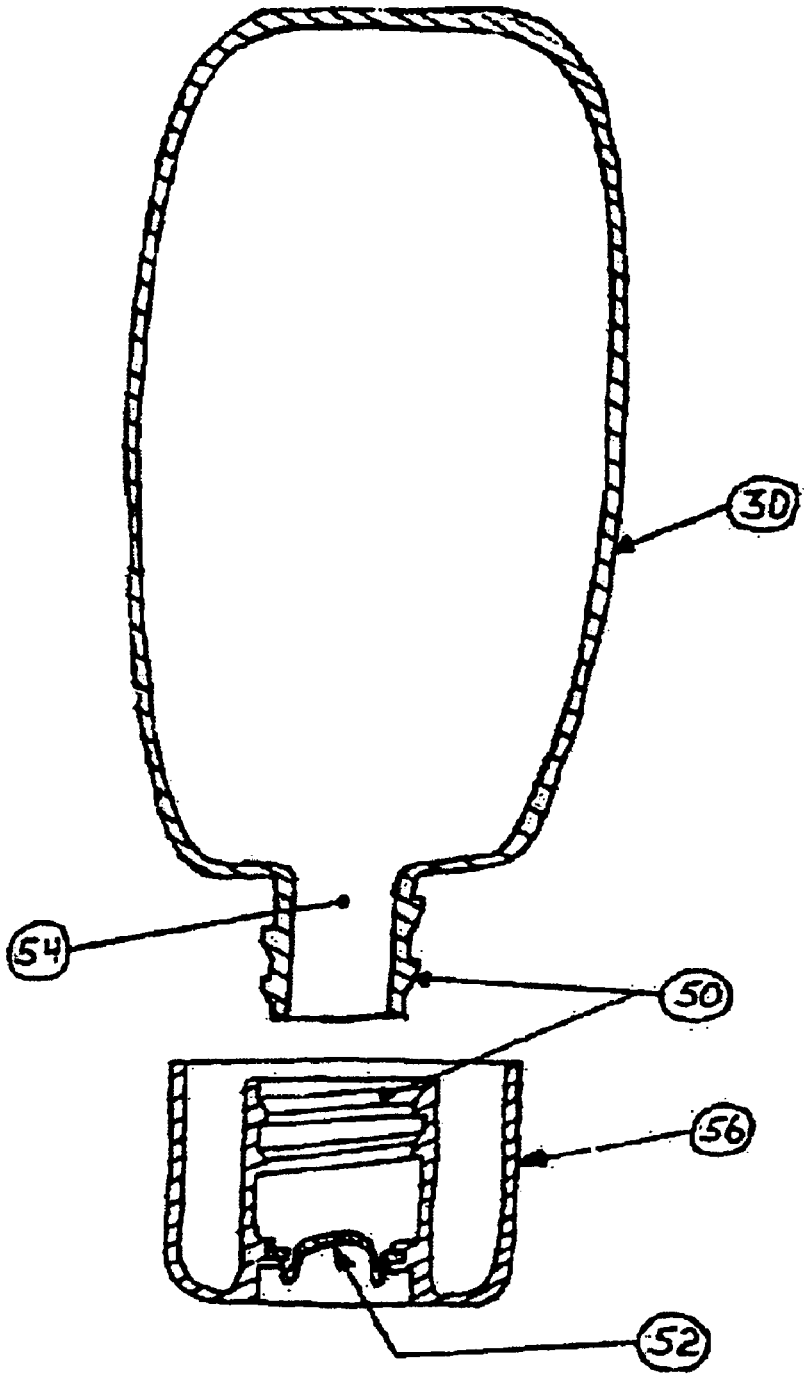
FIG. 5 shows an enlarged cross-section of the valve and the threaded attachment mechanism 50 which connects the body of the valve 56 to the container 30 over orifice 54. The location of the elastomeric seal 52 is also shown.

From the foregoing, it will be appreciated that although specific embodiments of the invention have been described herein for purposes of illustration, various modifications may be made without deviating from the spirit or scope of the invention.

What is claimed is:

1. A container which is adhered in an inverted orientation to a vertical surface of a kitchen, sink, or bath room by a stretch release adhesive, wherein said stretch release adhesive is resistant or substantially resistant to water and humidity, which container comprises:

a. one or more side surfaces, an end surface and a surface comprising an orifice;

b. a self-sealing valve which covers said orifice;

c. a construction or coating that is resistant or substantially resistant to external corrosion;

and wherein said container is dispensed by the action of a human hand applying a force whose principal component acts perpendicularly or approximately perpendicularly to the vertical surface and the stretch release adhesive is a laminate in which one portion of the laminate is permanently bonded to the wall of the container.

2. A container according to claim 1 in which the stretch release adhesive is able to support the container's weight under the conditions of a constant water flow for between about 15 and about 10000 minutes.

3. A container according to claim 1 in which the stretch release adhesive is able to support the container's weight under the conditions of a constant water flow for between about 60 and about 10000 minutes.

4. A container according to claim 1 in which the stretch release adhesive is able to support the container's weight under the conditions of a constant water flow for between about 1000 and about 10000 minutes.

5. A container according to claim 1 in which the external surface of the side wall is convex and the stretch release adhesive tape has a thickness between 3 mm and 15 mm.

6. A container according to claim 1 in which the end surface is convex.

7. A container according to claim 1 in which the side walls of the said container are deformable.

8. A container according to claim 1 wherein said self-sealing valve is attached to an exit conduit, through which the contents of the container must pass, and wherein the orientation of said exit conduit is inclined to the said vertical surface.

9. A container according to claim 1 which comprises a self sealing valve that uses an elastomeric material to form the closure.

10. A container according to claim 1 wherein said self sealing valve is an aerosol tilt or vertically activated valve.

11. A container according to claim 1 which is a pressurized container containing a liquefied propellant or compressed gas.

12. A container according to claim 1 which contains a composition comprising greater than about 0.1% to about 40% of a surfactant.

13. A container according to claim 1 which contains a composition whose rheology is shear thinning.

14. A container according to claim 13 in which the composition has a shear thinning index between $10^1$ and $10^9$.

15. A container according to claim 13 in which the composition has a shear thinning index between $10^2$ and $10^6$.

16. A container according to claim 1 which can be operated to dispense product with a single hand.

17. A method for dispensing a product which comprises actuating a self-sealing valve of a container according to claim 1.

18. A container according to claim 1 wherein said stretch release adhesive is disposed upon a substrate, said substrate having a tab which is accessible to a human hand and may be pulled by said hand so as to release said stretch release adhesive.

19. A container according to claim 1 wherein said stretch release adhesive is disposed upon a substrate, said substrate having a tab, which is exposed on physical removal of the container from said vertical surface, whereupon said tab can be pulled so as to release said stretch release adhesive from said vertical surface.

* * * * *